US007891282B1

(12) United States Patent
DeGroat

(10) Patent No.: US 7,891,282 B1
(45) Date of Patent: Feb. 22, 2011

(54) BOOSTER FOR HANDGUN SILENCERS

(75) Inventor: James Earl DeGroat, Milan, NM (US)

(73) Assignee: Advanced Armament Corp., Lawrenceville, GA (US)

( * ) Notice: Subject to any disclaimer, the term of this patent is extended or adjusted under 35 U.S.C. 154(b) by 336 days.

(21) Appl. No.: 12/220,253

(22) Filed: Jul. 23, 2008

(51) Int. Cl.
*F41A 21/38* (2006.01)

(52) U.S. Cl. ..... 89/14.4; 181/223

(58) Field of Classification Search ..... 89/14.1–14.5; 181/223
See application file for complete search history.

(56) References Cited

U.S. PATENT DOCUMENTS

| | | | | |
|---|---|---|---|---|
| 863,342 | A * | 8/1907 | Alber | 181/271 |
| 1,462,158 | A * | 7/1923 | Wildner | 89/14.4 |
| 1,525,846 | A * | 2/1925 | Wurtzebach | 181/223 |
| 1,773,443 | A * | 8/1930 | Wilman | 89/14.4 |
| 3,164,060 | A * | 1/1965 | Dahl | 89/14.2 |
| 3,500,955 | A * | 3/1970 | Werbell | 181/223 |
| 3,677,132 | A * | 7/1972 | Plenge | 89/14.2 |
| 5,136,924 | A * | 8/1992 | Forster et al. | 89/14.4 |
| 5,164,535 | A | 11/1992 | Leasure | |
| 7,308,967 | B1 | 12/2007 | Hoel | |
| 7,353,740 | B1 * | 4/2008 | Hoffman | 89/14.05 |
| 7,588,122 | B2 * | 9/2009 | Brittingham | 181/223 |
| 7,610,710 | B2 * | 11/2009 | Brittingham | 89/14.4 |
| 7,676,976 | B2 * | 3/2010 | Dueck et al. | 42/90 |
| 7,677,150 | B2 * | 3/2010 | Dater et al. | 89/14.05 |
| 7,743,693 | B1 * | 6/2010 | Brittingham | 89/14.4 |
| 2007/0095198 | A1 * | 5/2007 | Dater et al. | 89/14.2 |
| 2008/0098880 | A1 * | 5/2008 | Brugger | 89/14.4 |

OTHER PUBLICATIONS

AAC GLOCK 9mm Suppressors, For GLOCK 17, 19, and 26 with AAC Evolution-9, Spider-2, Scorpion!; by AI Paulson; Combat Handguns; Harris Publications; Jun. 2006 issue.

AAC's Evolution-9, Suppressing hard-to-silence 9mm pistols including Beretta 92F; by AI Paulson: Special Weapons for Military and Police; Harris Publications; Fall 2006 issue.

* cited by examiner

*Primary Examiner*—Michael Carone
*Assistant Examiner*—Reginald Tillman, Jr.
(74) *Attorney, Agent, or Firm*—Wood, Herron & Evans, L.L.P.

(57) ABSTRACT

A booster apparatus that is to be used with an autoloading handgun is provided. The proposed novel device utilizes a piston with five spokes which are secured against rotational movement by interfacing with five of ten indexing notches that are machined on the stopping flange of the booster housing. There are ten indexing notches provided which allows for ten positions of orientation for the silencer in relation to the bore of the host firearm. Unnecessary rotational movement is prevented by the indexing notches which are robust and secure the piston in place. This device when utilized with a handgun silencer will facilitate the proper semi automatic function of the host firearm.

6 Claims, 4 Drawing Sheets

BOOSTER FOR HANDGUN SILENCERS

BACKGROUND OF THE INVENTION

1. Field of Invention

This invention relates in general to silencers and in particular to devices and methods for indexing the silencer's orientation as it relates to the muzzle of the host firearm.

2. Prior Art

Firearms silencers are well known in the prior art. The advantages of reducing the muzzle blast, noise and flash signature of a discharging firearm are well known. The apparatus and method herein described pertains to a booster mechanism which facilitates the autoloading function of the host firearm when the silencer is in place.

Autoloading handguns generally function by utilizing the energy generated by a discharged round of ammunition to extract, eject and load another round of ammunition. During the extraction and ejecting phase of operation, on "Browning" inspired designs, well known in the prior art, the barrel chamber drops below the level of the handgun's slide and the front of the barrel tilts up, above the axis of the slide. The addition of four or more ounces to the front of the barrel will typically prevent the proper operation of the handgun.

In general, effective silencer designs weigh more than four ounces. Due to weight considerations, a means to allow the host firearm to cycle was necessary. Boosters, as they are commonly referred to, are incorporated into the rear of a silencer to assist in the cycling of the host handgun. Some boosters work by increasing the pressure forced back into the handgun's operating system and others work by isolating the mass of the attached silencer through various means. Examples of these designs are found in the Advanced Armament Corp. ASAP system, Gemtech Tundra or the SWR Trident-9. In general the designs may work so as to allow the proper operating of the handgun, but fail to provide an effective, robust means by which to orient and adjust the orientation of the attached silencer.

Designs such as the Gemtech Tundra utilize a set screw which protrudes into the booster housing as a means to prevent the piston from freely rotating. Unfortunately these set screws can become threadedly unsecured inside of the housing allowing the silencer to rotate freely which will negatively affect the ability of the handgun to deliver accurate fire. Further, the set screw can break off inside of the housing with the same effect. The herein disclosed invention overcomes these weaknesses by providing a robust design which provides five solid indexing notches that positively engage the booster housing and prevents any unintended rotation of the associated silencer.

In the past, other booster designs have relied on specialized tools for the disassembly of the booster housing assembly for maintenance. Further, there was no other tool which could be substituted in emergency conditions for the proper maintenance of the booster housing. My design has no need of specialized tools because the retention cap incorporates surface structures which facilitate the disassembly of the booster assembly.

Additional objects, advantages, and novel features of the invention will be set forth in part in the description as follows, and in part will become apparent to those skilled in the art upon examination of the following, or may be learned by practice of the invention.

OBJECTS AND ADVANTAGES

Accordingly several objects and advantages of the present invention are

1. To provide a means of affecting a silencer's orientation in relation to the muzzle of the host firearm.
2. To provide a means to utilize the silencer to adjust the point of impact of the host firearm.
3. To provide a device that allows the host firearm to properly cycle with a silencer in place.
4. To provide a device that has interchangeable threaded inserts so that one silencer may be used on a variety of firearms.
5. To provide a device that does not require tools for disassembly.

Still further objects and advantages will become apparent from a consideration of the ensuing description and drawings.

SUMMARY

One embodiment of the proposed novel invention provides for a housing, piston, spring and retaining cap which are incorporated into an existing silencer and utilized on a handgun. The piston is machined so that it may be threadedly secured to the barrel of a firearm. The housing is designed to contain the piston and is threadedly secured to the silencer body. A centrally located aperture is provided at the distal end of the housing to allow a discharged projectile from a firearm to exit. The piston has an opening through its body, which aligns with the aperture of the housing which facilitates the passing through of a discharged projectile. A series of indexing notches are provided at the bottom of the housing where the piston is nested. The piston utilizes five spokes which interface with five, of ten, notches in the housing in any given orientation. This allows the piston to be oriented in ten different positions. A spring is placed in the housing after the piston is in place and retained by a retaining cap. The retaining cap is designed so that no tool is necessary to threadedly retain it in the housing. The spring provides force to prevent the piston from backing out of the housing except during the discharge of the handgun or the orientation of the piston within the silencer.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION

Figure 1:
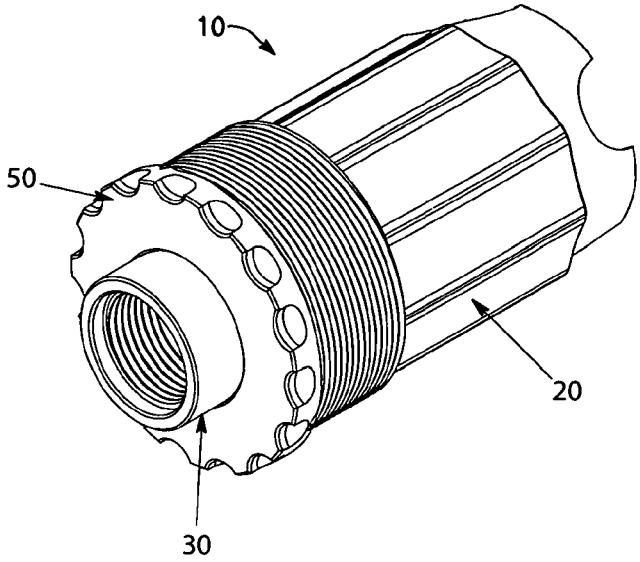
FIG. 1 is a side view of my improved booster for a handgun silencer.

Turning now to the drawings in which like reference characters indicate corresponding elements throughout the several views, attention is directed to FIG. 1 which illustrates an embodiment of the herein proposed invention: an improved silencer booster 10 is shown fully assembled. The primary components of this device are the booster housing 20, the piston 30; the coil spring 40 (shown in FIGS. 2, 3 & 5), and the retention cap 50.

Figure 2:
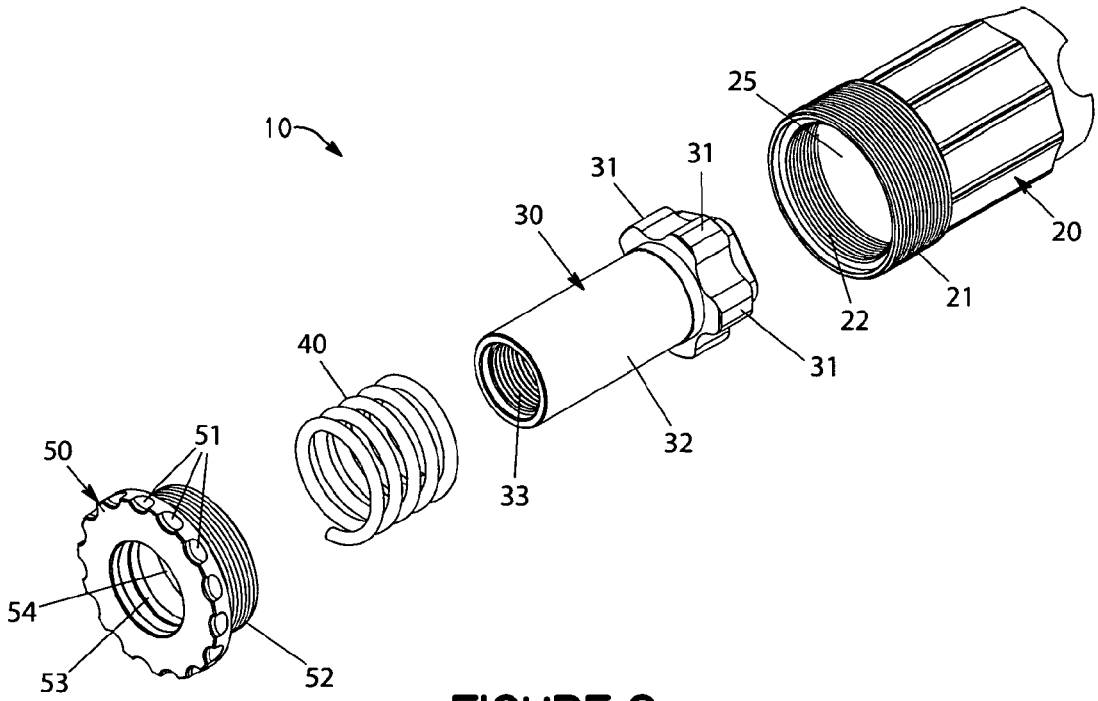
FIG. 2 is an exploded side view from the proximal end thereof.
Figure 3:
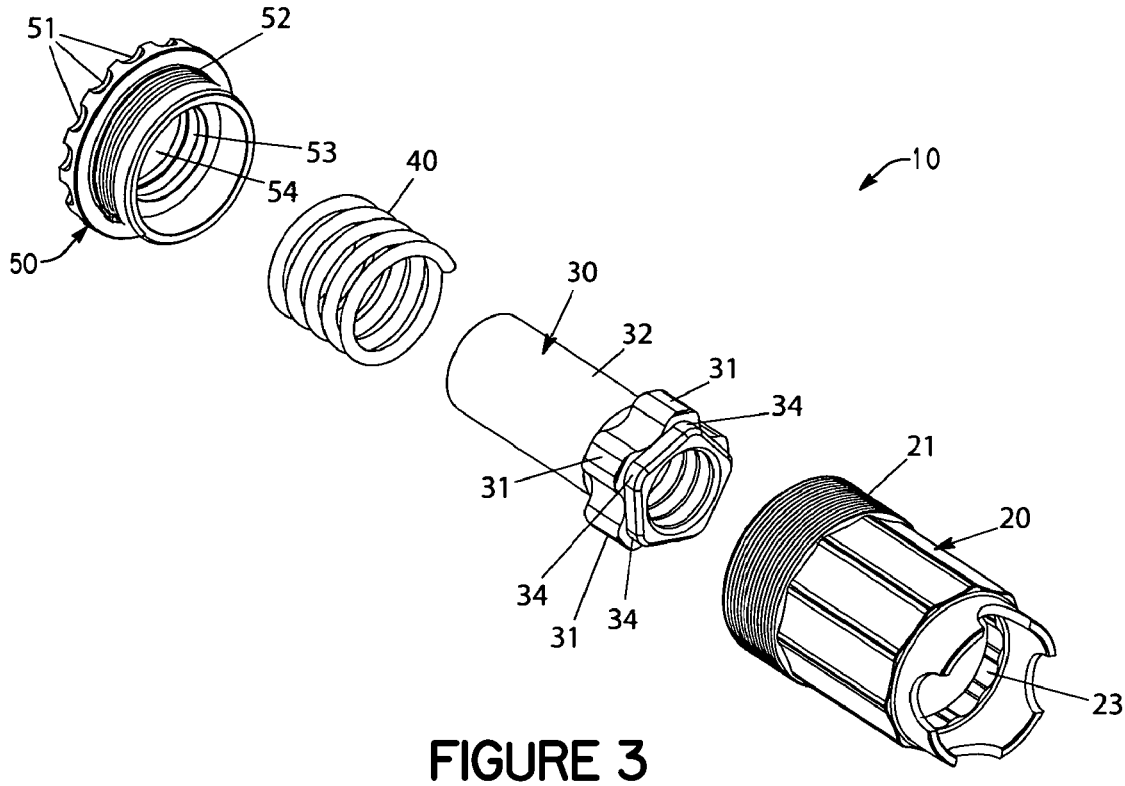
FIG. 3 is an exploded side view from the distal end thereof.

FIGS. 2 & 3 show exploded horizontal side views of the improved silencer booster 10. Housing 20 has external threads 21 located about its periphery near the proximal end of the housing 20. Internal threads 22 are provided near the proximal end of the housing 20. Housing 20 is machined from steel. Piston 30 is machined from steel. A series of stopping spokes 31 are located about the periphery of the piston 30 near the distal end. Stopping spokes 31 are machined so that the piston 30 will fit within the housing 20. Inside of the booster housing 20 approximate the distal end is located, shown in FIG. 6, a stopping shoulder 24 where ten evenly spaced indexing notches 23 are located about its external area. Near the proximal end of the piston 30 there is located an internal thread 33 which is utilized to removably secure the piston to a firearm barrel 61. At the extreme distal end of the piston 30 are the indexing spokes 34. Indexing spokes 34 are pentagonal in shape. A coil spring 40 is utilized within the housing 20. Coil spring 40 has a void large enough to accommodate the piston shaft 32. The retention cap 50 has an external thread 52 that threadedly secures to the internal thread 22 of the housing 20. Also present is an opening 54 which is large enough for the piston shaft 32 to pass through. This allows the piston 30 to be translatable in one of a forward direction and a rearward direction. The internal walls 53 of retention cap 50 support the piston 30. An internal cut 55 inside of the opening 54 on retention cap 50 houses an o-ring 56. Located about the retention cap 50 are a series of gripping surfaces 51 which are semi-circular in shape.

Figure 4:
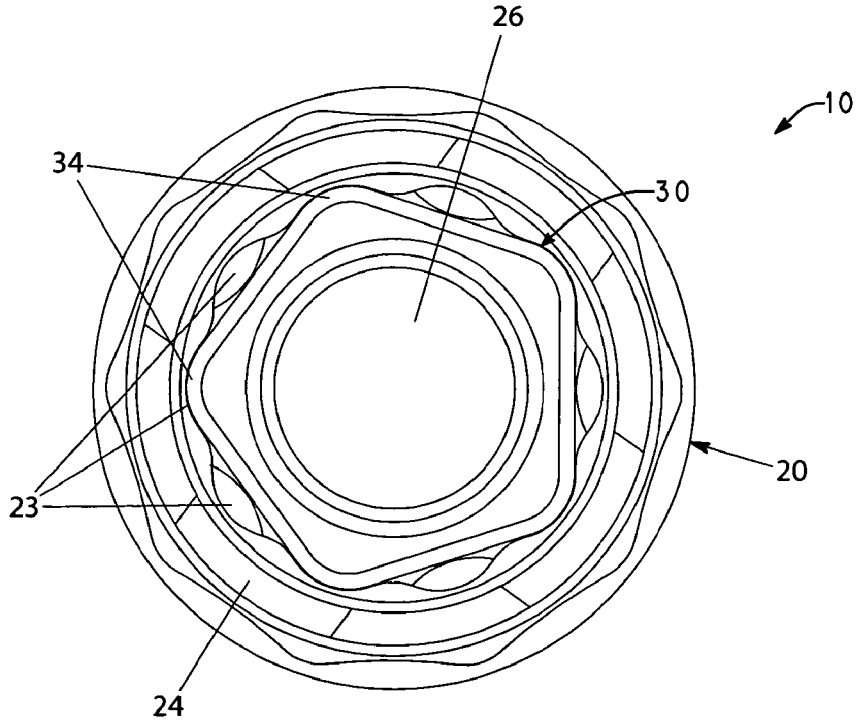
FIG. 4 is an end view from the distal end thereof.
Figure 6:
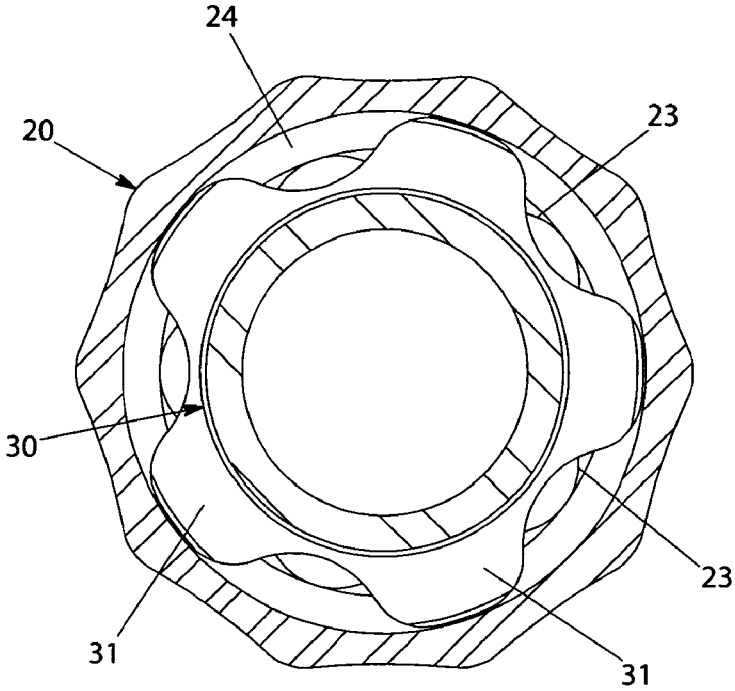
FIG. 6 is a cutaway end view of the distal end of the improved booster for a handgun silencer and piston from the proximal direction.

FIG. 4 illustrates a view of the distal end of the booster housing 20. FIG. 6 illustrates the same features in a cutaway view taken from the proximal direction. Ten indexing notches 23 located about the interior of the stopping shoulder 24 are shown interfacing with five indexing spokes 34 located on the front of the piston 30. Ten indexing notches 23 are present about the interior of the stopping shoulder 24. Indexing spokes 34 located about the distal end of the piston 30 are prevented from rotational movement once the piston 30 is fully seated within the housing 20 and the indexing spokes 34 are seated within the indexing notches 23. Indexing notches 23 are spaced about the stopping shoulder 24 so that the indexing spokes 34 are afforded ten positions of orientation.

Figure 5:
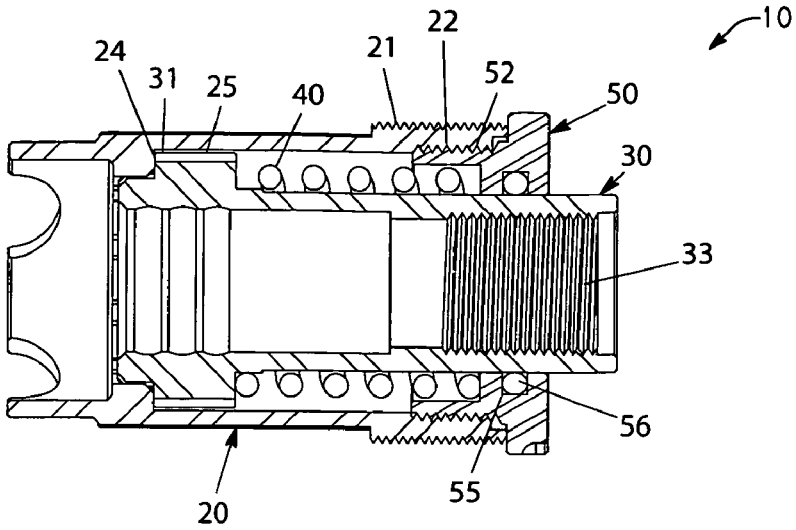
FIG. 5 is a sectional view of the booster assembly.

FIG. 5 illustrates a cutaway view of the booster housing 20 when fully assembled. Piston 30 has a proximal end and a distal end. The proximal end has a thread 33 which is utilized to threadedly secure the piston 30 to a firearm barrel 61. The internal area of the piston 30 is hollow so that a bullet might pass through unhindered. The distal end of the piston 30 has five indexing spokes 34 (illustrated in FIGS. 2 & 3) and five stopping spokes 31. Annular stopping shoulder 24 located near the distal end of the boost housing 20 protrudes from the booster housing wall 25 sufficiently to prevent the five stopping spokes 31 of piston 30 from traveling past. Coil spring 40 is placed about the piston 30 and contained within the booster housing 20 by retention cap 50. Retention cap 50 has an external thread 52 which interacts with the internal threads 22 of the booster housing 20. Further, retention cap 50 has gripping surfaces 51 which provides the means by which the user secures the retention cap 50 to the booster housing 20 thereby containing the piston 30 and coil spring 40 within the housing 20. Also shown is retention cap 50 with internal cut 55 with o-ring 56 in place.

Figure 7:
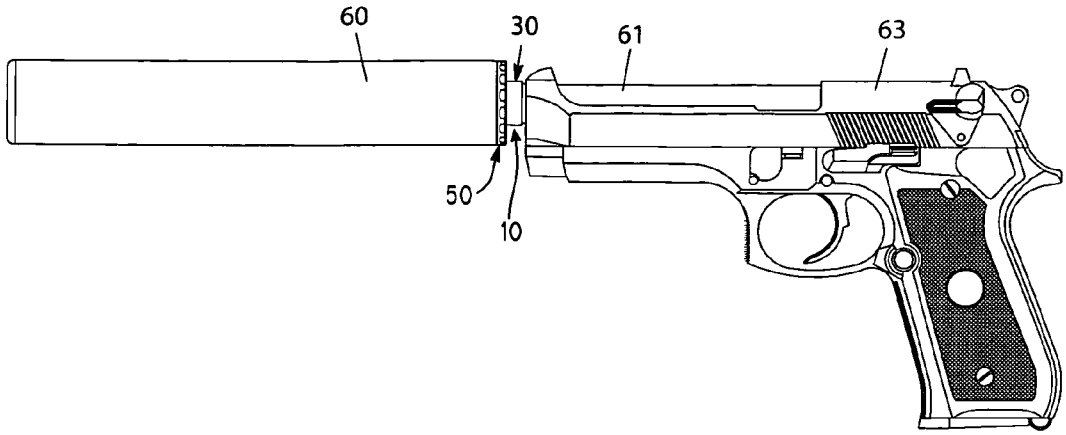
FIG. 7 is a perspective view of a handgun and silencer utilizing the improved booster for a handgun silencer.

FIG. 7 illustrates a perspective view of a firearm 62, firearm barrel 61, with a silencer 60, utilizing the improved booster for handgun silencers 10, threadedly secured about the firearm barrel 61.

Improved booster for handgun silencers 10 is secured to a silencer 60 body by external mounting threads 21 located near the proximal end of the booster housing 20. Retention cap 50 secures piston 30 and coil spring 40 within booster housing 20. Silencer 60 utilizing the improved booster for handgun silencers 10 is threadedly secured about a firearm barrel 61 by piston retention threads 33. The user may adjust the orientation of silencer 60 as it relates to firearm barrel 61 by grasping silencer 60 and pulling it forward of the firearm. This motion compresses coil spring 40 and allows piston 30 to rotate freely. Once silencer 60 and booster housing 20 are rotated to the desired position, the user releases silencer 60 so that indexing spokes 34 and indexing notches 23 are allowed to once again interface and prevent rotational movement of the silencer 60 and piston 30 within the booster housing 20. The pentagonal shape of the indexing spokes 34 and the decagonal shape of booster housing 20 indexing notches 23 are machined so that the piston 30 may be oriented in one of ten positions at any given time.

Gripping surfaces 51 located about retention cap 50 allow the user to threadedly restrain retention cap 50 to booster housing 20 without the need for specialized tools. The o-ring 56 provided with retention cap 50 minimizes debris from escaping the booster housing 20 during normal use.

The improved booster 10 is designed to be incorporated into the proximal end of the silencer 60. Piston 30 utilizes threads 33 as a means to removably secure the improved booster 10, and thereby the silencer 60, to a firearm barrel 61. When expanding gases exit the firearm barrel 61, entering both the booster housing 20 and the silencer 60, the gases push the silencer away from the firearm thereby relieving the firearm barrel 61 of the silencer's weight during cycling. Coil spring 40 resists the movement of the silencer 60 and is thereby compressed. Piston stopping spokes 31 keep the firearm barrel's exit aperture 62 aligned with the centrally located void 26 (shown in FIG. 4) within the booster housing 20. As expanding gases exit the distal end of the silencer 60 and pressure is reduced, the coil spring 40, located about piston 30 contained by the retention cap 50, expands back to its non compressed state. When the coil spring 40 has returned to its non compressed state, indexing spokes 34 reengage the indexing notches 23 located inside of booster housing 20.

As used herein, the word "front" or "forward" or "distal" corresponds to the direction which a discharged projectile would pass through the improved booster housing 20 (i.e., to the left as shown in FIGS. 1-2, & 5); "rear" or "rearward" or "back" or "proximal" corresponds to the direction opposite the direction of a discharged projectile passing through the improved booster housing 20 (i.e., to the right as shown in FIGS. 1-2, & 5); "longitudinal" means the direction along or parallel to the longitudinal axis of the improved booster housing 20; and "transverse" means a direction perpendicular to the longitudinal direction.

CONCLUSION, RAMIFICATIONS, AND SCOPE

Accordingly the reader will see that, according to the invention, I have provided a method for adjusting the orientation of a silencer while mounted on the barrel of a firearm. The orientation method requires no special tools and ten positions of adjustment are provided for. Further, the herein described invention requires no special tools for the disassembly of the booster housing during maintenance of the internal components. The improved booster for handgun silencers may be incorporated into any handgun silencer with very little modification to the original design and ensures the reliable auto loading function of the host firearm.

While my above drawings and description contain many specificities, these should not be constructed as limitations on the scope of the invention, but rather as an exemplification of one embodiment thereof.

Accordingly, the scope of the invention should be determined not by the embodiments illustrated, but by the appended claims and their legal equivalents.

The invention claimed is:

1. A booster for a silencer, comprising:

a piston with a proximal end and a distal end, the proximal end of the piston configured to couple to a firearm such that a projectile can pass through the piston from the proximal end to the distal end, the distal end of the piston including an outer periphery and a forward protrusion inwardly spaced from the outer periphery having a geometric shape with at least three sides; and a housing configured to couple to a silencer, the housing comprising an internal shoulder with a plurality of notches to receive the geometric shape on the distal end of the piston;

wherein the piston is translatable relative to the housing in at least one of the proximal and distal directions during discharge of a firearm coupled to the piston.

2. The booster of claim 1, the booster further comprising a spring coupled to the housing and to the piston to allow translation of the piston relative to the housing.

3. The booster of claim 1, wherein the geometric shape at the distal end of the piston protrusion is a pentagon of five substantially equilateral sides and five substantially evenly-spaced corners, and wherein the internal shoulder of the housing has ten notches substantially evenly-spaced therein to receive the substantially evenly-spaced corners of the pentagon on the distal end protrusion of the piston.

4. The booster of claim 1, the booster further comprising a rear cap configured to couple to the housing, the rear cap comprising a plurality of exterior serrated cuts to form a gripping surface.

5. The booster of claim 4, the booster further comprising an o-ring located interior to the rear cap, the o-ring positioned to contact the piston.

6. The booster of claim 1, the piston further comprising a plurality of spokes defining at least in part the outer periphery and bearing against an internal wall of the housing during translation of the piston relative to the housing.

* * * * *